US005101137A

United States Patent [19]

Kun et al.

[11] Patent Number: 5,101,137

[45] Date of Patent: Mar. 31, 1992

[54] INTEGRATED TFEL FLAT PANEL FACE AND EDGE EMITTER STRUCTURE PRODUCING MULTIPLE LIGHT SOURCES

[75] Inventors: Zoltan K. Kun, Churchill; Alan F. Mandel, Mt. Lebanon, both of Pa.

[73] Assignee: Westinghouse Electric Corp., Pittsburgh, Pa.

[21] Appl. No.: 377,690

[22] Filed: Jul. 10, 1989

[51] Int. Cl.[5] ..... H01J 1/62

[52] U.S. Cl. ..... 313/509; 313/506; 346/107 R

[58] Field of Search ..... 313/506, 509, 499, 500; 346/107 R; 340/701, 703, 781

[56] References Cited

U.S. PATENT DOCUMENTS

| | | | |
|---|---|---|---|
| 4,006,383 | 2/1977 | Luo et al. | 315/169 TV |
| 4,110,664 | 8/1978 | Asars et al. | 315/169 TV |
| 4,464,602 | 8/1984 | Murphy | 313/509 |
| 4,535,341 | 8/1985 | Kun et al. | 346/107 R |
| 4,734,723 | 3/1988 | Ishitobi | 346/160 |
| 4,899,184 | 2/1990 | Leksell et al. | 346/155 |

FOREIGN PATENT DOCUMENTS

| | | |
|---|---|---|
| 0369755 | 5/1990 | European Pat. Off. . |
| 0372942 | 6/1990 | European Pat. Off. . |
| 63-91998 | 4/1988 | Japan . |

*Primary Examiner*—Donald J. Yusko
*Assistant Examiner*—Diab Hamadi
*Attorney, Agent, or Firm*—John K. Williamson

[57] ABSTRACT

A thin film electroluminescent (TFEL) device for producing multiple light sources. The device is comprised by a TFEL flat panel structure containing light energy generating material and having front and rear faces and side edges extending between the faces. The panel structure is composed of a face emitter portion and an edge emitter portion. The face emitter portion is operable for emitting light energy from one of the front and rear faces of the flat panel structure in a direction substantially perpendicular to the plane of the flat panel structure. The edge emitter portion is operable for emitting light energy from one of the side edges of the flat panel structure in a direction substantially parallel to the plane of the flat panel structure.

14 Claims, 2 Drawing Sheets

INTEGRATED TFEL FLAT PANEL FACE AND EDGE EMITTER STRUCTURE PRODUCING MULTIPLE LIGHT SOURCES

CROSS REFERENCE TO RELATED APPLICATION

Reference is hereby made to the following copending applications dealing with related subject matter and assigned to the assignee of the present invention:

U.S. Pat. application Ser. No. 343,697, filed Apr. 24, 1989, and now U.S. Pat. No. 4,899,184, entitled "A Multiplexed Thin Film Electroluminescent Edge Emitter Structure And Electronic Drive System Therefor". (W.E. 54,925)

U.S. Pat. application Ser. No. 353,316, filed May 17, 1989, and now U.S. Pat. No. 5,043,715, entitled "Thin Film Electroluminescent Edge Emitter Structure With Optical Lens And Multi-Color Light Emission Systems", a continuation-in-part of U.S. Pat. application Ser. No. 280,909, filed Dec. 7, 1988, and now abandoned, which is a continuation-in-part of U.S. Pat. application Ser. No. 248,868, filed Sept. 23, 1988. (W.E. 55,192)

BACKGROUND OF THE INVENTION

1. Field of the Invention

The present invention relates generally to a thin film electroluminescent light source, and more particularly, is concerned with an integrated TFEL flat panel face and edge emitter structure for simultaneously producing multiple light sources 2. Description of the Prior Art Electroluminescence is a phenomena which occurs in certain materials from the passage of an electric current through the material. The electric current excites the electrons of the dopant in the light emitting material to higher energy levels. Emission of radiation thereafter occurs as the electrons emit or give up the excitation energy and fall back to lower energy levels. Such electrons can only have certain discrete energies. Therefore, the excitation energy is emitted or radiated at specific wavelengths depending on the particular material.

Thin film electroluminescent (TFEL) devices that employ the above-mentioned electroluminescence phenomena have been devised in the prior art. It is well known to utilize a TFEL device to provide an electronically controlled, high resolution light source. One arrangement which utilizes the TFEL device to provide the light source is a flat panel display system, such as disclosed in Asars U.S. Pat. No. (4,110,664) and Luo U.S. Pat. No. (4,006,383), assigned to the assignee of the present invention. In a TFEL flat panel display system, light emissions are produced substantially normal to a face of the device and so provide the light source at the device face. Another arrangement utilizing the TFEL device to provide the light source is a line array, or edge, emitter, such as disclosed in a Kun U.S. Pat. No. (4,535,341), also assigned to the assignee of the present invention. In a TFEL edge emitter system, light emissions are produced substantially normal to an edge of the device and so provide the light source at the device edge. A printer is disclosed in the Kun et al patent which employs a TFEL edge emitter device as the light source.

It is known in the prior art to provide the TFEL device either as a face emitter structure for applications requiring a large area light source, such as a flat panel display, or as an edge emitter structure for applications requiring only a narrow light source, such as a light-activated printer. However, unknown in the prior art is an integrated structure which provides the TFEL device as both face and edge emitter devices suitable for applications which heretofore have been assumed to require separate components.

SUMMARY OF THE INVENTION

The present invention provides an integrated TFEL flat panel face and edge emitter structure designed to fill the gap left by the prior art. The integrated TFEL flat panel structure can produce multiple light sources for concurrent applications, such as displaying and printing the same image.

Accordingly, the present invention is directed to a thin film electroluminescent (TFEL) device for producing multiple light sources. The device is comprised by a TFEL flat panel structure having front and rear faces and side edges extending between the faces. The panel structure is composed of a face emitter portion and an edge emitter portion. The face emitter portion is operable for emitting light energy from one of the front and rear faces of the flat panel structure in a direction substantially perpendicular to the plane of the flat panel structure. The edge emitter portion is operable for emitting light energy from one of the side edges of the flat panel structure in a direction substantially parallel to the plane of the flat panel structure , More particularly, the face and edge emitter portions preferably share a common substrate. In addition to the substrate, each portion includes a pair of electrode layers, at least one and preferably a pair of dielectric layers interposed between the electrode layers and a layer of light generating material, such as phosphor, interposed between the dielectric layers. The electrode layers dielectric layers and phosphor layer are formed in a generally stacked laminar arrangement and are disposed on the common layer of substrate material.

These and other features and advantages of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

In the course of the following detailed description, reference will be made to the attached drawings in which.

DESCRIPTION OF THE PREFERRED EMBODIMENT

Figure 1:
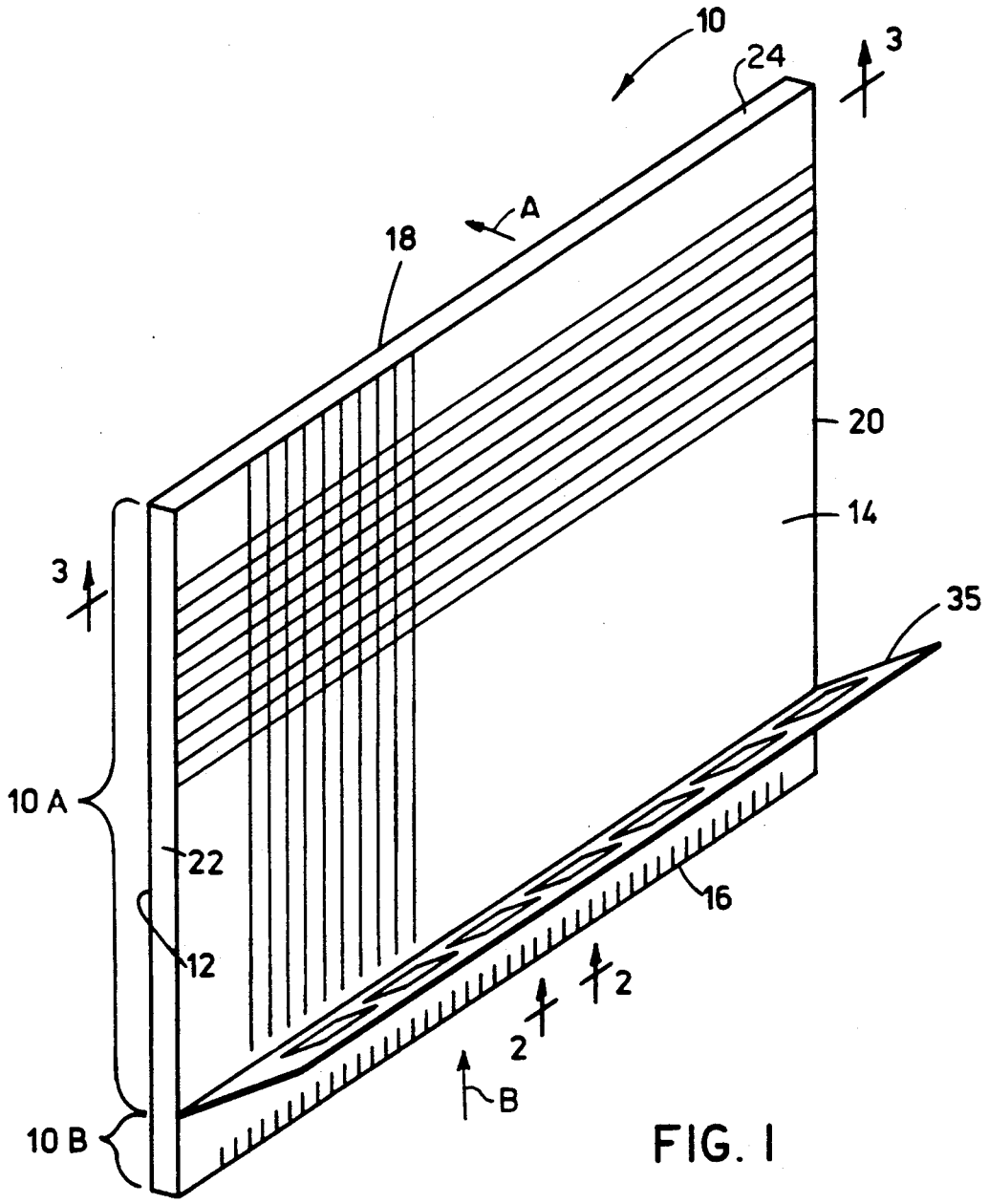
FIG. 1 is a perspective view of an integrated TFEL flat panel face and edge emitter structure in accordance with the principles of the present invention, the drive electronics for the flat panel display portion are omitted.

Referring to the drawings, and particularly to FIG. 1, there is illustrated an integrated TFEL flat panel face and edge emitter structure which can provide a solid state, electronically controlled high resolution multiple light source. The integrated emitter structure is a TFEL flat panel 10 having front and rear faces 12, 14 and side edges 16, 18, 20, 22 extending between the faces 12, 14.

In accordance with the present invention, the TFEL flat panel 10 is composed of a face emitter portion 10A and an edge emitter portion 10B. The face emitter portion 10A is operable for emitting light energy from one of the faces, for example the front face 12, of the flat panel 10 in the direction of arrow A which is substantially perpendicular to the plane of the flat panel 10. The edge emitter portion 10B is operable for emitting light energy from one of the side edges, for example the bottom edge 16, of the flat panel 10 in the direction of arrow B which is substantially perpendicular to arrow A and parallel to the plane of the flat panel 10. The face and edge emitter portions 10A, 10B of the flat panel 10 can share a common substrate 24, as shown in FIG. 1, or separate substrates placed end-to-end, as represented by the dashed line in FIG. 1. The material of the substrate 24 is typically glass which is transparent to light energy.

Figure 2:
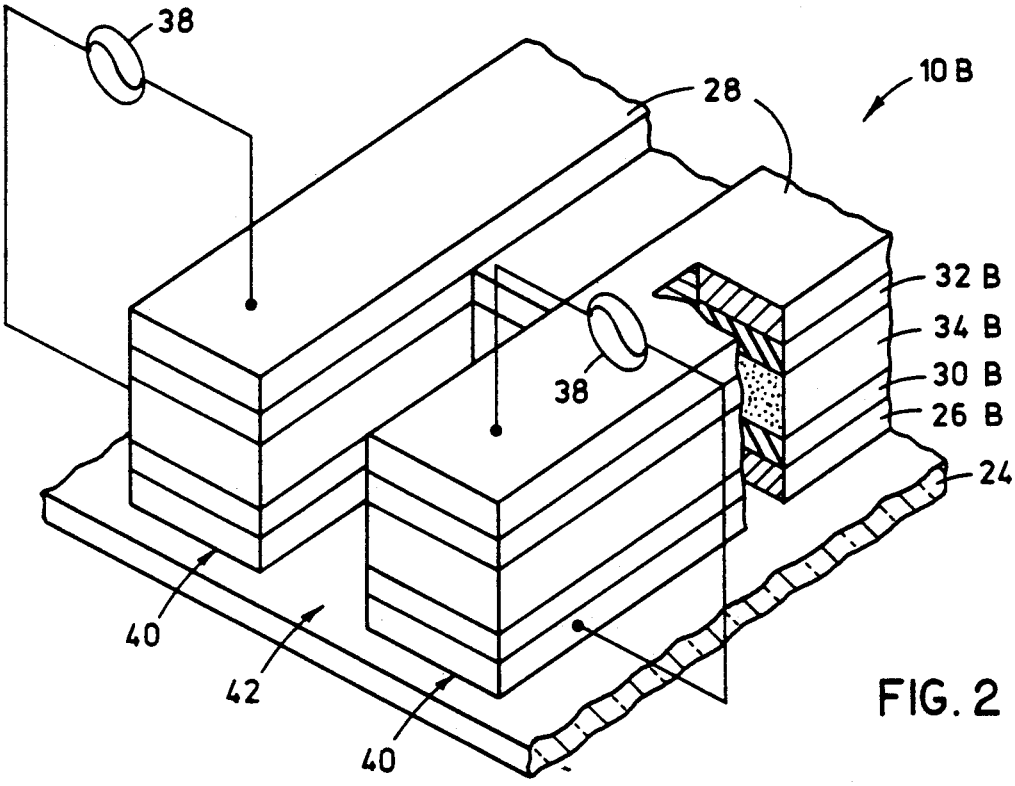
FIG. 2 is an enlarged fragmentary perspective view of an edge emitter portion of the structure as seen along line 2—2 of FIG. 1.
Figure 3:
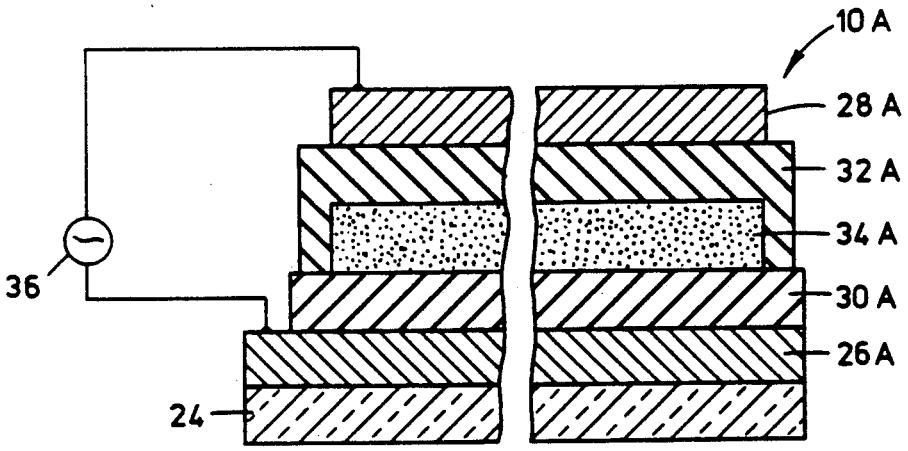
FIG. 3 is an enlarged cross-sectional view of the face emitter portion of the structure taken along line 3—3 of FIG. 1.

The face and edge emitter portions 10A, 10B of the flat panel 10 each employ a laminar stack of substantially identical layers. As seen in FIGS. 2 and 3, the respective face and edge emitter portions 10A, 10B are each composed of a pair of electrode layers 26A, 28A and 26B, 28B, at least one and preferably a pair of dielectric layers 30A, 32A and 30B, 32B interposed between the electrode layers and an active layer 34A, 34B of light generating material interposed between the dielectric layers. By way of example, the dielectric layers 30A, 32A and 30B, 32B are composed of a high dielectric strength, high dielectric constant material, preferably yttrium oxide ($Y_2O_3$). The layer 34A, 34B of light generating material is preferably zinc sulfide doped with manganese (ZnS:Mn). Preferably, the control electrodes 28A, 28B of the face and edge emitter portions 10A, 10B are separate from one another permitting selective excitation for creating images in the light emitted by the layers 34A, 34B. The same or different images can be created. An electrical connector 35 is shown in FIG. 1 connected to the control electrodes 28B of the edge emitter portion 10B. The control electrodes 28A of the face emitter portion 10A are shown in the form of a matrix in FIG. 1.

The layers 26A, 28A, 30A, 32A of the face emitter portion 10B can be integral with the layers 26B, 28B, 30B, 32B of the edge emitter portion 10B of the flat panel 10. Alternatively, the respective stacks of layers of the face and edge emitter portions 10A, 10B can be optically separated or isolated from one another to avoid cross talk and noise between them. However, the separated stacks can still be disposed on a common layer 24 of substrate material.

In operation, an alternating current source 36, 38 coupled across the electrode layers 26A, 28A and 26B, 28B is operated to energize the respective face and edge emitter portions 10A, 10B. The active layer 34A, 34B will luminesce and light emitted therefrom will be externally transmitted through the front face 12 and bottom edge 16, respectively. The light transmits through the front face 12 of the face emitter portion 10A of the flat panel 10 in view that the electrode layer 28A at the rear face 14 is opaque or non-transparent to light energy, whereas the electrode layer 26A at the front face 12 next to the substrate 24 is transparent to light energy. Also, all side edges 18, 20, 22 of the flat panel 10, except the bottom side edge 16 of the edge emitter portion 10B, are opaque to light energy. On the other hand, the light transmits through the bottom edge 16 of the edge emitter portion 10B of the flat panel 10 in view that both electrode layers 26B, 28B are opaque or non-transparent to light energy. By way of example, the transparent electrode can be composed of indium-tin oxide $(In,Sn)O_2$, and the opaque electrodes can be composed of aluminum (Al).

As is well known, the edge emitter portion 10B can be provided as a multiplicity of pixels 40 separated by a generally rectangular channel 42 formed in the TFEL flat panel bottom edge 16. The channel 42 typically extends vertically through the layers 26, 28, 30, 32 to the substrate 24 and also a preselected distance rearwardly from the edge 16 into the central portion of the TFEL edge emitter portion 10B. The channels 42 serve to optically isolate adjacent pixels from one another to prevent optical cross-talk. The front edges of the pixels 40 of the TFEL edge emitter portion 10B are the light emission sources thereof. Typically, the rear edges (not shown) of the pixels 40 are coated with a layer of non-metallic reflective coating Potential applications for the integrated TFEL flat panel face and edge emitter structure are those where concurrent light images are desired, for example, a display provided by the face emitter portion 10A for generating a visual picture and a printhead provided by the edge emitter portion 10B for generating a hard copy.

It is thought that the present invention and many of its attendant advantages will be understood from the foregoing description and it will be apparent that various changes may be made in the form, construction and arrangement of the parts of the invention described herein without departing from the spirit and scope of the invention or sacrificing all of its material advantages, the forms hereinbefore described being merely preferred or exemplary embodiments thereof.

I claim:

1. A thin film electroluminescent multiple light source device, comprising:

(a) a thin film electroluminescent flat panel structure having front and rear faces and side edges extending between said faces and including a pair of electrode layers, at least one dielectric layer interposed between said electrode layers and a layer of light interposed between said dielectric layer and one of said electrodes;

(b) said panel structure being composed of a face emitter portion and an edge emitter portion;

(c) said face emitter portion being operable or emitting light energy from one of said front and rear faces of said flat panel structure in a direction substantially perpendicular to the plane of said flat panel structure;

(d) said edge emitter portion being operable for emitting light energy from one of said side edges of said flat panel structure in a direction substantially parallel to the plane of said flat panel structure;

(e) said layers of said face emitter portion of said flat panel structure being separated from said layers of said edge emitter portion thereof.

2. The device as recited in claim 1 wherein said face and edge emitter portions share a common substrate.

3. The device as recited in claim 1, wherein said layers are formed in a generally stacked laminar arrangement and are disposed on the common layer of substrate material.

4. A thin film electroluminescent multiple light source device, comprising:

(a) a thin film electroluminescent flat panel structure having front and rear faces and side edges extending between said faces;

(b) said panel structure being composed of a face emitter portion and an edge emitter portion;

(c) said face emitter portion being operable for emitting light energy from one of said front and rear faces of said flat panel structure in a direction substantially perpendicular to the plane of said flat panel structure;

(d) said edge emitter portion being operable for emitting light energy from one of said side edges of said flat panel structure in a direction substantially parallel to the plane of said flat panel structure;

(e) said face and edge emitter portions of said flat panel structure each including a pair of electrode layers, at least one dielectric layer interposed between said electrode layers and a layer of light generating material interposed between said dielectric layer and one of said electrodes;

(f) said layers of said face emitter portion of said flat panel structure being separated from said layers of said edge emitter portion thereof.

5. The device as recited in claim 4, wherein said separated layers of said respective face and edge emitter portions are formed in a generally stacked laminar arrangement and are disposed on the common layer of substrate material.

6. The device as recited in claim 5, wherein both of said electrode layers of said edge emitter portion of said flat panel structure are non-transparent to light energy.

7. The device as recited in claim 5, wherein one of said electrode layers of said face emitter portion of said flat panel structure is non-transparent to light energy and the other of said electrode layers of said face emitter portion is transparent to light energy.

8. The device as recited in claim 7, wherein the material of said substrate layer is transparent to light energy and disposed adjacent said transparent electrode layer.

9. An integrated thin film electroluminescent flat panel face and edge emitter structure, comprising:

(a) a thin film electroluminescent flat panel structure having front and rear faces and side edges extending between said faces and including a pair of electrode layers, a pair of dielectric layers interposed between said electrode layers and a layer of light generating material interposed between said dielectric layers, said layers being formed in a generally stacked laminar arrangement;

(b) said panel structure being composed of a face emitter portion and an edge emitter portion of said stacked laminar arrangement;

(c) said face emitter portion being operable for emitting light energy from one of said front and rear faces of said flat panel structure in a direction substantially perpendicular to the plane of said flat panel structure;

(d) said edge emitter portion being operable for emitting light energy from one of said side edges of said flat panel structure in a direction substantially parallel to the plane of said flat panel structure;

(e) said layers of said face emitter portion of said flat panel structure being isolated from said layers of said edge emitter portion thereof.

10. The structure as recited in claim 9 wherein said face and edge emitter portions of said stacked laminar arrangement share a common substrate.

11. The device as recited in claim 9, wherein said isolated layers of said respective face and edge emitter portions are formed in a generally stacked laminar arrangement and are disposed on the common layer of substrate material.

12. The device as recited in claim 9, wherein one of said electrode layers of said face emitter portion of said flat panel structure is non-transparent to light energy and the other of said electrode layers of said face emitter portion is transparent to light energy.

13. The device as recited in claim 9, wherein the material of said substrate layer is transparent to light energy and disposed adjacent and transparent electrode layer.

14. The device as recited in claim 9, wherein both of said electrode layers of said edge emitter portion of said flat panel structure are non-transparent to light energy.

* * * * *